US005342722A

United States Patent [19]

Ito et al.

[11] Patent Number: 5,342,722

[45] Date of Patent: Aug. 30, 1994

[54] TONER RESIN COMPOSITION AND PROCESS FOR PREPARING SAME

[75] Inventors: Hirokazu Ito; Masahiro Itoh; Motoshi Inagaki, all of Toyohashi; Syuji Takahiro, Kasugai; Keiji Yoshida, Nagoya, all of Japan

[73] Assignee: Mitsubishi Rayon Company Ltd., Tokyo, Japan

[21] Appl. No.: 878,910

[22] Filed: May 6, 1992

[51] Int. Cl.[5] ..... G03G 9/00; G03G 9/13

[52] U.S. Cl. ..... 430/109; 430/111; 430/114; 430/137; 430/904; 430/908

[58] Field of Search ..... 430/106.6, 107, 109, 430/110, 111, 114, 904, 908, 137

[56] References Cited

U.S. PATENT DOCUMENTS

| | | | |
|---|---|---|---|
| 3,391,082 | 7/1968 | Maclay . | |
| 3,459,787 | 8/1969 | Weesner . | |
| 3,502,582 | 3/1970 | Clemens et al. . | |
| 3,513,133 | 5/1970 | Weesner . | |
| 4,016,332 | 4/1977 | Anderson et al. . | |
| 4,148,741 | 4/1979 | Bayley . | |
| 4,156,764 | 5/1979 | White | 526/211 |
| 4,518,724 | 5/1985 | Kuwajima et al. | 523/501 |
| 4,533,614 | 8/1985 | Fukumoto et al. | 430/99 |
| 4,557,991 | 12/1985 | Takagiwa et al. | 430/109 |
| 4,758,626 | 7/1988 | Ishihara et al. | 525/148 |
| 4,833,060 | 5/1989 | Nair et al. . | |
| 4,835,084 | 5/1989 | Nair et al. | 430/137 |
| 4,942,105 | 7/1990 | Yu | 430/59 |
| 4,965,131 | 10/1990 | Nair et al. | 430/137 X |
| 4,985,328 | 1/1991 | Kumagai et al. | 430/110 |

FOREIGN PATENT DOCUMENTS

| | | |
|---|---|---|
| 1102037 | 5/1981 | Canada . |
| 0104805 | 4/1984 | European Pat. Off. . |
| 259868 | 3/1988 | European Pat. Off. . |
| 304040 | 2/1989 | European Pat. Off. . |
| 0462785 | 12/1991 | European Pat. Off. . |
| 0469752 | 2/1992 | European Pat. Off. . |
| 2757429 | 7/1979 | Fed. Rep. of Germany . |
| 3729496 | 3/1988 | Fed. Rep. of Germany . |
| 47-6749 | 2/1972 | Japan . |
| 49-2196 | 1/1974 | Japan . |
| 51-109093 | 9/1976 | Japan . |
| 51-35514 | 10/1976 | Japan . |
| 51-049212 | 12/1976 | Japan . |
| 58-159546 | 9/1983 | Japan . |
| 59-226053 | 12/1984 | Japan . |
| 61-009416 | 1/1986 | Japan . |
| 61-179202 | 8/1986 | Japan . |
| 63-070861 | 3/1988 | Japan . |
| 63-279265 | 11/1988 | Japan . |
| 2-167563 | 6/1990 | Japan . |

OTHER PUBLICATIONS

M. L. Hallensleben, "Copolymers From Disulphide Polymers and Vinyl Monomers By Radical Chain Transfer", 13 *European Polymer Journal* 437–440 (1970).

(List continued on next page.)

*Primary Examiner*—Maurice J. Welsh
*Assistant Examiner*—Shelley A. Dodson
*Attorney, Agent, or Firm*—Finnegan, Henderson, Farabow, Garrett & Dunner

[57] ABSTRACT

A toner resin composition comprising 5 to 40% by weight of a polyester (A) having a weight average molecular weight of 3,000 to 20,000 and 50 to 95% by weight of a styrene-acrylic copolymer (B). The styrene-acrylic copolymer (B) is comprised of 10 to 25% by weight of a high molecular weight polymer (B1) having a weight average molecular weight of 500,000 to 1,100,000 and 75 to 90% by weight of a low molecular weight polymer (B2) having a weight average molecular weight of 5,000 to 100,000. The high molecular weight polymer (B1) is comprised of a styrene component (b-1) and an acrylic ester and/or methacrylic ester component (b-2). The low molecular weight polymer (B2) is comprised of a styrene component (b-1), an acrylic ester and/or methacrylic ester component (b-2), 0.3 to 3 parts by weight, per 100 parts of the total weight of said component (b-1) and component (b-2), of an $\alpha$-methyl styrene dimer (b-3) and 0.5 to 30 parts by weight, per 100 parts by weight of said polyester (A), of a glycidyl methacrylate component (b-4).

24 Claims, No Drawings

OTHER PUBLICATIONS

Y. Chujo, et al., "Synthesis of Segmental Copolyamides By Using Telechelic Prepolymers", 185 *Makromol. Chem.* 2077–87 (1984).

T. Miyashita, et al., "Kinetics of the Thermal Decompositions of Diaryl and Dialkyl Disulfides", 48 *Bull. of the Chem. Soc'y of Japan*3230–35 (1975).

Patent Abstracts of Japan, vol. 14, No. 430 (P–1106) (4373), Sep. 14, 1990.

Patent Abstracts of Japan, vol. 13, No. 98 (P–840) (3446), Mar. 8, 1989.

Patent Abstract of Japan, vol. 7, No. 286 (P–244) (1431), Dec. 21, 1983.

Derwent Publications Ltd., London, GB; Sec. Ch, Week 3292, Class A04, AN 92–263191 [32].

TONER RESIN COMPOSITION AND PROCESS FOR PREPARING SAME

BACKGROUND OF THE INVENTION

1. Field of the Invention

The present invention relates to a toner resin composition having an excellent balance of properties such as non-offsetting properties, fixation properties, blocking resistance and so on, and typically used in electrophotography and electrostatic printing, and to a process for the preparation thereof.

2. Description of the Related Art

The image forming process in electrophotography and electrostatic printing consists of a developing process wherein a photoelectrically conductive insulating layer is uniformly charged to form an electrical latent image by exposure to light, followed by a visualization of that image by an adhesion of toner to the latent image, a process wherein this visible image is transferred to paper, etc., and a process wherein the image is fixed by heating and pressure.

Thus, in the development process, the toner must have charge properties that allow it to maintain a suitable amount of charge even if changes occur in the surrounding environment (humidity, temperature, etc.) so that it is able to favorably adhere to the electrical latent image. In addition, in the fixation process, the toner must have favorable fixation properties with respect to the paper, etc., and must have non-offsetting properties so that it does not adhere to the heat roller when using a heat roller, etc. for fixation. Moreover, blocking must not occur in the toner during storage in a copier and so on.

Based on these properties, styrene-acrylic resins, polyester resins and so on were used in the prior art.

Nevertheless, although toner comprised of a styrene-acrylic resin demonstrates stable charge properties (moisture resistance) as a result of being minimally effected by the environment during use, its fixation to paper is not adequate. On the other hand, although toner comprised of a polyester resin has a favorable fixation to paper, the moisture resistance thereof is poor. Moreover, it is difficult to properly balance the non-offsetting and fixation properties of these types of resins.

SUMMARY OF THE INVENTION

The primary object of the present invention is to provide a toner resin composition having a proper balance of offsetting properties, fixation properties, moisture resistance and blocking resistance, and able to provide a toner having a stable quality, and a process for the preparation thereof.

As a result of intensive research on the part of the present inventors with respect to a composite resin of a polyester resin and a styrene-acrylic resin, it was found that a specific composition can be provided with the favorable characteristics of both resins, and that such a favorable composition can be stably obtained according to a specific process, which led to the completion of the present invention. In other words, the present invention is the toner resin composition and a process for the preparation thereof described below:

A toner resin composition comprising 5 to 40% by weight of a polyester (A) having a weight average molecular weight of 3,000 to 20,000 and 50 to 95% by weight of a styrene-acrylic copolymer (B), wherein said styrene-acrylic copolymer (B) is comprised of 10 to 25% by weight of a high molecular weight polymer (B1) having a weight average molecular weight of 500,000 to 1,100,000 and 75 to 90% by weight of a low molecular weight polymer (B2) having a weight average molecular weight of 5,000 to 100,000, said high molecular weight polymer (B1) is comprised of a styrene component (b-1) and an acrylic ester and/or methacrylic ester component (b-2), and said low molecular weight polymer (B2) is comprised of a styrene component (b-1), an acrylic ester and/or methacrylic ester component (b-2), 0.3 to 3 parts by weight, per 100 parts of the total weight of said component (b-1) and component (b-2), of an $\alpha$-methyl styrene dimer (b-3) and 0.5 to 30 parts by weight, per 100 parts by weight of said polyester (A), of a glycidyl methacrylate component (b-4).

A toner resin composition comprising:

5 to 40% by weight of a polyester (A) having a structure originating in a divalent carboxylic acid component (a-1), 0.2 to 0.7 mole, per mole of said divalent carboxylic acid, of an aromatic diol component (a-2) and 0.3 to 0.8 mole, per mole of said divalent carboxylic acid, of an aliphatic diol component (a-3) and having a weight average molecular weight of 3,000 to 20,000, an acid value of 0.5 to 10 mgKOH/g, a glass transition temperature of 40° to 68° C. and a softening temperature of 80° to 160° C.; and, 60 to 95% by weight of a styrene-acrylic copolymer (B) formed by using a styrene component (b-1), an acrylic ester and/or methacrylic ester component (b-2), an s-methyl styrene dimer (b-3) and a glycidyl methacrylate component (b-4) in amounts, per 100 parts of the total weight of said component (b-1) and component (b-2), of 50 to 90 parts by weight of said component (b-1), 10 to 50 parts by weight of said component (b-2) and 0.3 to 3 parts by weight of said dimer (b-3) and 0.5 to 30 parts by weight, per 100 parts by weight of said polyester (A), of said component (b-4);

wherein said styrene-acrylic copolymer (B) is comprised of 10 to 25% by weight of a high molecular weight polymer (B1) having a weight average molecular weight of 500,000 to 1,100,000 and 75 to 90% by weight of a low molecular weight polymer having a weight average molecular weight of 5,000 to 100,000, and has a glass transition temperature of 40° to 68° C., a softening point of 100° to 160° C. and an acid value of 0.1 to 10 mgKOH/g.

A process for preparing a toner resin composition comprising a polyester (A) a styrene-acrylic copolymer (B) wherein said styrene-acrylic copolymer (B) is comprised of 10 to 25% by weight of a high molecular weight polymer (B1) having a weight average molecular weight of 500,000 to 1,100,000 and 75 to 90% by weight of a low molecular weight polymer (B2) having a weight average molecular weight of 5,000 to 100,000, which process comprises of the steps of, subjecting 10 to 25% by weight of a styrene component (b-1) and an acrylic ester and/or methacrylic ester component (b-2) to form an emulsion of a high molecular weight polymer (B1) having a weight average molecular weight of 500,000 to 1,100,000 to emulsion polymerization, and adding, to the obtained emulsion, 5 to 40% by weight of a polyester (A) having a weight average molecular weight of 3,000 to 20,000 and at least a styrene component (b-1), an acrylic ester and/or methacrylic ester component (b-2), 0.3 to 3 parts by weight, per 100 parts of the total weight of said component (b-1) and component (b-2), of an α-methyl styrene dimer (b-3) and 0.5 to 30 parts by weight, per 100 parts by weight of said polyester (A), of a glycidyl methacrylate component (b-4), and subjecting the mixture to suspension polymerization.

DESCRIPTION OF THE PREFERRED EMBODIMENTS

The following provides a detailed explanation of the toner resin composition and its preparation process of the present invention.

The polyester (A) in the toner resin composition of the present invention may be obtained by condensation polymerization of a divalent carboxylic acid component (a-1), an aromatic diol component (a-2) and an aliphatic diol component (a-3). For example, said polyester (A) may be obtained by an esterification reaction or transesterification reaction of the divalent carboxylic acid component (a-1) and diol components (a-2 and a-3) followed by condensation polymerization in a high vaccum. In addition, a linear polyester is desirable for this polyester (A).

Examples of the divalent carboxylic acid component (a-1) may include maleic acid, fumaric acid, itaconic acid, cyclohexane dicarboxylic acid, terephthalic acid, isophthalic acid, adipic acid and sebacic acid. In addition, the acid anhydrides and lower alkylesters of these divalent carboxylic acids are also included in the divalent carboxylic acid component. Further, two or more of these substances may be used in combination.

Examples of the aromatic diol component (a-2) may include bis-phenol A, bis-phenol S, bis-phenol F, hydrogenated bis-phenol A, polyoxypropylene-(n)-polyoxyethylene-(n')-2,2-bis(4-hydroxyphenyl)propane, polyoxypropylene-(n')-2,2-bis(4-hydroxyphenyl)propane, polyoxyethylene-(n)-2,2-bis(4-hydroxyphenyl)propane and polyoxypropylene-(n)-hydroxone (where $2 \leqq n$ and $n' \leqq 6$). In addition, two or more of these substances may be used in combination.

The amount of the aromatic diol component (a-2) that is used should be 0.2 to 0.7 moles with respect to 1 mole of the divalent carboxylic acid component (a-1) of which the structure originates in that component (a-2). The blocking resistance of the toner in particular will be favorable as a result of using said aromatic diol component (a-2) in an amount within this range.

Examples of the aliphatic diol component (a-3) may include ethylene glycol, diethylene glycol, triethylene glycol, polyethylene glycol, propylene glycol, 1,2-butanediol, 1,3-butanediol, cyclohexane dimethanol and neopentyl glycol. In addition, two or more of these substances may be used in combination.

The amount of the aliphatic diol component (a-3) that is used should be 0.3 to 0.8 moles with respect to 1 mole of divalent carboxylic acid component (a-1) having a structure originating in that component (a-3). The blocking resistance of the toner in particular will be favorable as a result of using said aliphatic diol component (a-3) in an amount within this range.

The weight average molecular weight (to be abbreviated as Mw) of the polyester (A) is 3,000 to 20,000. Polyesters having an Mw within this range have a favorable compatibility with the styrene-acrylic copolymer (b) in particular.

The acid value of the polyester (A) may be 0.5 to 10 mgKOH/g. It may be difficult to obtain polyesters having an acid value less than 0.5 mgKOH/g by condensation polymerization. Conversely, the moisture resistance of the toner may be poor where the acid value exceeds 10 mgKOH/g.

The glass transition temperature (to be abbreviated as Tg) of polyester (A) may be 40° to 68° C. Where the Tg is less than 40° C., the blocking resistance of the toner may become poor. Conversely, where the Tg exceeds 68° C., the fixation properties of the toner may become poor.

The softening temperature of polyester (A) may be 80° to 160° C. The blocking resistance of the toner may become poor when the softening temperature is less than 80° C. Conversely, the fixation properties of the toner may become poor when the softening temperature exceeds 160° C.

The styrene-acrylic copolymer (B) in the toner resin composition of the present invention is a copolymer obtained from the styrene component (b-1), acrylic ester and/or methacrylic ester component (b-2) (to be generically referred to as (meth)acrylic ester component (b-2)), α-methylstyrene dimer (b-3), and glycidyl methacrylate component (b-4).

Examples of the styrene component (b-1) may include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-phenylstyrene and 3,4-dichlorostyrene.

Examples of the (meth)acrylic ester component (b-2) may include ethyl acrylate, methyl acrylate, n-butyl acrylate, isobutyl acrylate, propyl acrylate, 2-ethylhexyl acrylate, stearyl acrylate, ethyl methacrylate, methyl methacrylate, n-butyl methacrylate, isobutyl methacrylate, propyl methacrylate, 2-ethylhexyl methacrylate, stearyl methacrylate, dimethylaminoethyl methacrylate and diethylaminoethyl methacrylate.

The ratio of the amounts of the styrene component (b-1) and (meth)acrylic ester component (b-2) may be such that the amount of the component (b-1) is 50 to 90 parts by weight and the amount of the component (b-2) is 10 to 50 parts by weight with respect to 100 parts by weight of the total amount of the component (b-1) and component (b-2). Moreover, it is preferable that the amount of the component (b-1) be 60 to 85 parts by weight and the amount of the component (b-2) be 15 to 40 parts by weight. The moisture resistance of the toner may become poor when the amount of the component (b-1) used is less than 50 parts by weight, and toner fixation properties may become poor when the amount of the component (b-1) used is in excess of 90 parts by weight.

The amount of the α-methylstyrene dimer component (b-3) used may be 0.3 to 3 parts by weight with respect to 100 parts by weight of the total amount of the component (b-1) and component (b-2). An amount of the α-methylstyrene component (b-3) used within this range may demonstrate action which lowers the molecular weight of the styrene-acrylic copolymers, and consequently improves the compatibility between the styrene acrylic copolymer (B) and polyester (A) in particular.

The amount of the glycidyl methacrylate component (b-4) used may be 0.5 to 30 parts by weight with respect to 100 parts by weight of the polyester (A). An amount of the component (b-4) used within this range may demonstrate an action which assists the compatibility between the styrene-acrylic copolymer (B) and polyester (A). In addition, this range also allows a stable and favorable polymerization reaction.

In addition, the Tg of the styrene-acrylic copolymer (B) may preferably be 40° to 68° C., and the softening temperature may preferably be 100° to 160° C. If this Tg is less than 40° C., there are cases in which the blocking resistance of the toner may be poor, and when it exceeds 68° C., there are cases in which the fixation properties of the toner may be poor. In addition, if the softening temperature is less than 100° C., there are cases in which the non-offsetting properties of the toner may be poor, and when it exceeds 160° C., there are cases in which the fixation properties of the toner may be poor.

The constituent ratio of the polyester (A) and styrene-acrylic copolymer (B) may be such that the amount of the polyester (A) is 5 to 40% by weight and the amount of the styrene-acrylic copolymer (B) is 60 to 95% by weight with respect to 100% by weight of the total amount of both constituents. Where the amount of the polyester (A) is less than 5 wt %, the fixation properties of the toner may become poor. Conversely, when this exceeds 40 wt %, the moisture resistance of the toner may become poor. In addition, by making the constituent ratio within this range, polyester (A) and styrene-acrylic copolymer (B) can be uniformly dispersed to thus obtain a compound of a favorable quality. In addition, by making the amount of these constituents used within this range, the polymerization reaction in the preparation process of the present invention to be described to follow can be performed stably.

The styrene-acrylic copolymer (B) contained in the toner resin composition of the present invention is comprised of 10 to 25% by weight of a high molecular weight polymer (B1) having a weight average molecular weight of 500,000 to 1,100,000, and 75–90% by weight of a low molecular weight polymer (B2) having a weight average molecular weight of 5,000 to 100,000. The non-offsetting properties and fixation properties of the toner in particular are balanced favorably as a result of this distribution of weight average molecular weight.

The Tg of the toner resin composition of the present invention may preferably be 40° to 68° C. If this is less than 40° C., the blocking resistance may become poor, and if this exceeds 68° C., the fixation properties may become poor.

The softening temperature of the toner resin composition of the present invention may be 100° to 160° C. If the softening temperature is less than 100° C., the non-offsetting properties may become poor, and if the softening temperature exceeds 160° C., the fixation properties may become poor.

The acid value of the toner resin composition of the present invention may be 0.1 to 10 mgKOH/g. An acid value within this range is most favorable from the viewpoint of the moisture resistance of the toner. The manufacturing of a toner having an acid value of less than 0.1 may be difficult, and the moisture resistance may become poor when the acid value exceeds 10 mgKOH/g.

The use of the toner resin composition of the present invention as described above results in favorable balance between each of the properties of non-offsetting properties, fixation properties, moisture resistance and blocking resistance, and allowing the obtaining of a toner having a stable quality, thereby attaining the object of the present.

The toner resin composition of the present invention described above may be obtained by any method, such as a simple blending or multi-stage polymerization, and there are no particular restrictions on that preparation process. Nevertheless, a compound having favorable properties can be easily obtained while also being superior in terms of uniform dispersion of the polyester (A) and styrene-acrylic copolymer (B) according to the preparation process of the present invention indicated previously. The following provides a detailed description of the preparation process of the present invention.

In the preparation process of the present invention, emulsion polymerization is first performed on the styrene component (b-1) and (meth)acrylic ester component (b-2) after which an emulsion of the styrene-acrylic copolymer having a high molecular weight (weight average molecular weight: 500,000–1,100,000) is obtained as a result of completion of this emulsion polymerization. Next, the polyester (A) and components (b-1) through (b-4) are added to this emulsion and suspension polymerization is performed ultimately allowing the obtaining of the toner resin composition wherein the styrene-acrylic copolymer (B) and polyester (A) are uniformly dispersed.

In this emulsion polymerization process, an emulsifier and a polymerization initiator are normally used together with the monomers, after which emulsion polymerization should be performed by introducing the above constituents into deionized water and heating to a suitable temperature.

The amounts of the styrene component (b-1) and (meth)acrylic ester component (b-2) used are 10–25 wt % of the 100 wt % of the total amount of resin composition ultimately obtained.

Examples of emulsifiers include routinely used nonionic and anionic hydrophilic emulsifiers and lipophilic emulsifiers. In the preparation process of the present invention in particular, anionic, water-soluble high molecular dispersants can be used, examples of which include carboxymethyl cellulose and vinyl polymers having a carboxylic acid metal salt or sulfonic acid metal salt on its side chain. More specific examples include a copolymer of a metal salt of an unsaturated carboxylic acid such as (meth)acrylic acid and an alkyl ester of an unsaturated carboxylic acid, such as (meth)acrylic acid, and, a homopolymer of an unsaturated carboxylic acid derivative having a sulfonic acid group on its side chain or a copolymer containing said monomer described in Japanese Examined Patent Publication No. 51-43877. The amount of this emulsifier used is preferably 0.2 to 4 parts by weight with respect to 100 parts by weight of the total amount of the styrene component (b-1) and (meth)acrylic ester component (b-2) used in emulsion polymerization.

In addition, a reactive surface active agent can be used for the emulsifier, and it is desirable to use a reactive surface active agent in the present invention. This reactive surface active agent is a surface active agent having a structure wherein hydrophilic and lipophilic groups or only hydrophilic groups are introduced into a compound having addition polymerizable double bonds. Examples of this compound having addition polymerizable double bonds include styrene, acrylic acid, itaconic acid, maleic acid, fumaric acid and allyl alcohols. In addition, examples of hydrophilic groups include anionic, cationic, ambiionic and nonionic groups similar to ordinary non-reactive surface active agents, with anionic groups in particular used in the present invention. Examples of anionic hydrophilic groups include $—SO_3M$, $—OSO_3M$, —COOM, and $—OPO_3M_2$ (where M is Na, K or $NH_4$). On the other hand, examples of lipophilic groups include —COOR (where R is $C_{12}$ or $C_{18}F$) and

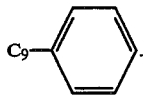

Reactive surface active agents wherein hydrophilic and lipophilic groups are introduced into allyl alcohol derivative structures are especially desirable. The amount of reactive surface active agent used is 0.1 to 2 parts by weight with respect to 100 parts by weight of the total amount of the styrene component (b-1) and (meth)acrylic ester (b-2) used in emulsion polymerization.

The polymerization initiator may be an initiator used in routine emulsion polymerization, examples of which include persulfates such as potassium persulfate and ammonium persulfate; peroxides such as hydrogen peroxide, benzoyl peroxide and tert-butyl perbenzoate; and, azo compounds such as azobisisobutyronitrile, 2,2'-azobis(2,4-dimethylvaleronitrile), 2,2'-azobis(2-methylbutyronitrile) and 1,1'-azobis(cyclohexane-1-carbonitrile). The amount of polymerization initiator used is preferably 0.1 to 0.4 parts by weight with respect to 100 parts by weight of the total amount of styrene component (b-1) and (meth)acrylic ester (b-2) used in emulsion polymerization.

The temperature of emulsion polymerization should be suitably set corresponding to the amount of initiator used and other conditions. In the case of using the initiator in an amount within the above-mentioned range, an emulsion polymerization temperature of roughly 65° to 75° C. is desirable. In addition, when emulsion polymerization is performed using the above-mentioned amount of initiator and at the above-mentioned temperature (reaction temperature), a high molecular weight emulsion can be easily obtained wherein the weight average molecular weight of the polymer particle is 500,000 to 1,100,000.

In this preparation process of the present invention, after obtaining an emulsion following completion of the above-mentioned emulsion polymerization, suspension polymerization is then performed by adding at least the above-mentioned polyester (A) and component (b-1) through (b-4). Other components added to the emulsion during the course of carrying out suspension polymerization normally include deionized water, a dispersant, a polymerization stabilizer and a polymerization initiator.

The polyester (A) that is added at this point has a weight average molecular weight of 3,000 to 20,000, and it is desirable that it have the structure and properties previously described with respect to the resin composition of the present invention. The amount of the polyester (A) used is 5 to 40 wt % of the 100 wt % of the total amount of resin composition ultimately obtained.

In addition, it is desirable to use, as the monomers to be added, the styrene component (b-1), (meth)acrylic ester component (b-2), α-methylstyrene dimer (b-3) and glycidyl methacrylate component (b-4) as mentioned above for the resin composition of the present invention.

The amount of the component (b-1) used in the suspension polymerization process is preferably on the order of 50 to 90 parts by weight with respect to 100 parts by weight of the total amount of the component (b-1) and component (b-2) used in suspension polymerization, and the amount of the component (b-2) used is preferably on the order of 10 to 50 parts by weight with respect to 100 parts by weight of the total amount of the component (b-1) and component (b-2) used in suspension polymerization. The amount of the α-methylstyrene dimer (b-3) used is 0.3 to 3 parts by weight with respect to 100 parts by weight of the total amount of the component (b-1) and component (b-2) used in emulsion polymerization and suspension polymerization, and the amount of the component (b-4) used is 0.5 to 30 parts by weight with respect to 100 parts by weight of the polyester (A). As previously described, these components act favorably with respect to uniform mixing between the polyester (A) and styrene-acrylic copolymer (B) in the composition.

Ordinary anionic or nonionic dispersants for suspension polymerization should be used for the dispersant, and both types may be used in combination. Examples of such dispersants include anionic dispersants similar to the emulsifier used in the previously described emulsion polymerization process, and routinely used nonionic dispersants such as polyvinyl alcohol. The amount of dispersant used is preferably 0.05 to 1 part by weight with respect to 100 parts by weight of the total amount of the component (b-1), component (b-2), component (b-4) and polyester (A) used in suspension polymerization.

The polymerization initiator used in the suspension polymerization process may be a routinely used initiator, examples of which include peroxides such as benzoyl peroxide and tert-butyl perbenzoate; and, azo compounds such as azobisisobutyronitrile, 2,2'-azobis(2,4-dimethylvaleronitrile), 2,2'-azobis(2-methylbutyronitrile) and 1,1'-azobis(cyclohexane-1-carbonitrile). The amount of polymerization initiator used is preferably 3 to 10 parts by weight with respect to 100 parts by weight of the total amount of the component (b-1), component (b-2), component (b-4) and polyester (A) used in suspension polymerization.

The temperature of suspension polymerization should be suitably set corresponding to the amount of initiator used and other conditions. In the case of using initiator in an amount within the above-mentioned range, the temperature of suspension polymerization is preferably on the order of 70° to 98° C. In addition, in the case of carrying out suspension polymerization using the above-mentioned amount of polymerization initiator and at this temperature (reaction temperature), the styrene-acrylic copolymer (B) can be obtained having a weight average molecular weight of 5,000 to 100,000. A molecular weight in this range results in favorable compatibility between the styrene-acrylic copolymer (B) and polyester (A).

As a result of passing through this two-step polymerization process consisting of emulsion polymerization and suspension polymerization, the contained acrylic copolymer (B) is composed of 10 to 25 wt % of the high molecular weight polymer (B1) having a weight average molecular weight of 500,000 to 1,100,000, and 75 to 90 wt % of the low molecular weight polymer (B2) having a weight average molecular weight of 5,000 to 100,000, thereby easily allowing the obtaining of a toner resin composition superior in terms of the uniformity of mixing of both resins.

In the present invention as described above, Tg is the temperature indicated at the point of intersection of the base line and a line tangent to the endothermic curve in the vicinity of Tg of a graph when measuring at a heating rate of 10° C./min using a differential calorimeter. The acid value is determined by titration with KOH in toluene solvent. The softening temperature is determined by measuring the temperature at which ½ of a 1 g sample begins to flow in a measurement method wherein a load of 30 Kgf is applied while heating at the rate of 3° C./min using a flow tester (Shimadzu CFT-500) equipped with a 1.0 mmϕ×10 mm nozzle. Mw was measured by conversion to polystyrene using the HCL-8020 of the Tosoh Corp.

The following provides a detailed description of the present invention, but the present invention is not limited to the following examples.

POLYESTER 1 PREPARATION EXAMPLE 2.36 moles by weight of terephthalic acid, 0.94 moles by weight of polyoxypropylene-(2,4)-2,2-bis(4-hydroxyphenyl) propane, 0.46 moles of polyoxyethylene-(2,4)-2,2-bis(4-hydroxyphenyl)propane, 1.65 moles of ethylene glycol and 0.12 parts by weight of antimony trioxide as a polymerization catalyst were placed in a reaction vessel equipped with a stirrer and distillation column and mixed thoroughly. An esterification reaction was then carried out by allowing water to run out of the reaction system while heating to a temperature within the reaction vessel of 260° C. at a stirring speed of 200 rpm. The outflow of water from the reaction system stopped roughly 3 hours after the outflow of water began, at which time the esterification reaction was terminated.

The pressure inside the reaction system was then reduced to 2 mmHg while maintaining the reaction temperature at 245° C. to carry out a condensation reaction by the outflow of ethylene glycol from the reaction system. The condensation reaction was terminated roughly 3 hours after the outflow of ethylene glycol from the reaction system, by returning the pressure of the reaction system to normal pressure. Finally, the resin was removed from the reaction vessel, rapidly cooled with water and dried.

The polyester resin obtained was a pale yellow solid. The acid value of this polyester resin was 4 mgKOH/g, the softening temperature was 105° C., Tg was 57.0° C. and Mw was 6,000.

POLYESTER 2 PREPARATION EXAMPLE

Other than using 2.30 moles of terephthalic acid, 0.46 moles of neopentyl glycol, 1.38 moles of polyoxypropylene-(2,4)-2,2-bis(4-hydroxyphenyl)propane, 1.15 moles of ethylene glycol, 0.12 parts by weight of antimony trioxide as a polymerization catalyst and 0.02 parts by weight of zinc acetate, an esterification reaction was carried out in the same manner as the Polyester 1 Preparation Example.

Following termination of the esterification reaction, the pressure inside the reaction system was then reduced to 2 mmHg while maintaining the reaction temperature at 245° C. to carry out a condensation reaction by the outflow of the diol component from the reaction system. The condensation reaction was terminated roughly 3 hours after the outflow of the diol component from the reaction system, by returning the pressure of the reaction system to normal pressure. Finally, the resin was removed from the reaction vessel, rapidly cooled with water and dried.

The polyester resin obtained was a pale yellow solid. The acid value of this polyester resin was 7 mgKOH/g, the softening temperature was 89° C., Tg was 43.0° C. and Mw was 3,000.

POLYESTER 3 PREPARATION EXAMPLE

Other than using 2.03 moles of terephthalic acid, 1.36 moles of isophthalic acid, 2.03 moles of neopentyl glycol, 0.68 moles of polyoxyethylene-(2,4)-2,2-bis(4-hydroxyphenyl)propane, 1.69 moles of ethylene glycol, 0.17 parts by weight of antimony trioxide and 0.01 parts by weight of tetrabutyl titanate, an esterification reaction and condensation reaction were carried out in the same manner as the Polyester 1 Preparation Example.

The acid value of the polyester resin obtained was 1.0 mgKOH/g, the softening temperature was 157° C., Tg was 65.0° C. and Mw was 18,000. In addition, the results of component analysis of polyesters 1-3 obtained in the manner described above are indicated in Table 1.

TABLE 1

| | Component Analysis (moles) | | | | | |
|---|---|---|---|---|---|---|
| | TPA | iPA | BPP | BPE | EG | NPG |
| Polyester 1 | 2.36 | — | 0.94 | 0.46 | 0.96 | — |
| Polyester 2 | 2.30 | — | 1.38 | — | 0.49 | 0.43 |
| Polyester 3 | 2.03 | 1.36 | — | 0.68 | 0.71 | 2.00 |

Monomer symbols in table:
TPA: Terephthalic acid
EG: Ethylene glycol
iPA: Isophthalic acid
NPG: Neopentyl glycol
BPP: Polyoxypropylene-(2,4)-2,2-bis(4-hydroxyphenyl)propane
BPE: Polyoxyethylene-(2,4)-2,2-bis(4-hydroxyphenyl)propane

Preparation Example of Dispersant A 900 g of deionized water, 25 g of methyl methacrylate and 75 g of 3-sodium sulfopropylmethacrylate were charged into a separation flask having a content volume of 2 liters equipped with a stirrer, thermometer and gas feed tube. Air inside the system was purged by blowing in $N_2$ gas for 30 minutes. Next, 0.5 g of ammonium persulfate were added raising the temperature to 60° C. by heating from the outside in a hot water bath while stirring. When stirring was continued for 3 hours at this same temperature, a bluish-white polymer solution (solid portion approx. 10%) was obtained having a viscosity of 340 centipoise (25° C.).

EXAMPLE 1

Styrene, n-butylacrylate, n-butylmethacrylate, methyl acrylate, ethylacrylate and potassium persulfate were placed in a 5 liter reaction vessel equipped with a distillation column and stirrer in accordance with the composition of Table 2 and mixed. In addition, 4000 ppm of dispersant A with respect to the amount of monomers placed in the reaction vessel, and 6 volumes of deionized water with respect to the amount of monomers were also placed in the reaction vessel. Next, $N_2$ gas was fed into the reaction vessel for roughly 1 hour. The reaction temperature was then maintained at 70° C. while holding the stirring rate at 175 rpm and setting the $N_2$ gas flow rate to 100 ml/min. When the temperature inside the reaction system reached 70° C., emulsion polymerization gradually began, resulting in the formation of reflux. Reflux of the reaction system discontinued after roughly 4 hours from the beginning of emulsion polymerization, at which time the flow of $N_2$ gas was stopped and emulsion polymerization terminated.

Next, after lowering the temperature of the reaction system to 40° C., deionized water in an amount equal to the total amount of all monomers used in suspension polymerization, 600 ppm of dispersant A and 300 ppm of sodium polyacrylate with respect to the total amount of all monomers used in suspension polymerization, 1 wt % of mirabilite with respect to the total amount of all monomers used in suspension polymerization, as well as styrene, n-butylacrylate, n-butylmethacrylate, methylacrylate, ethylacrylate, glycidyl methacrylate, polyester 1, α-methylstyrene dimer and benzoyl peroxide were placed in the reaction vessel in accordance with the composition of Table 1 followed by mixing for roughly 1 hour while maintaining the stirring rate at 350 rpm. After 1 hour, the temperature was raised until the temperature of the reaction system reached 85° C. When the temperature of the reaction system reached 85° C., the reaction system began to give off heat. Suspension polymerization was then carried out while maintaining the outside temperature at 82° C. and controlling the temperature of the reaction system at 85° C. 1 hour after the temperature of the reaction system reached 85° C., the reaction no longer gave off heat and the outside temperature of the reaction system was increased to 88° C. While maintaining the temperature within the reaction system at 85° C., suspension polymerization was terminated maintaining this state after roughly an additional 1 hour.

Next, the reaction system was heated to 100° C. and residual monomers were removed from the reaction system. The temperature of the reaction system was then lowered and maintained at 90° C. followed by alkaline treatment for roughly 30 minutes with 0.5 wt % sodium hydroxide with respect to the total amount of all monomers used in suspension polymerization. The reaction system was then cooled to lower the temperature to room temperature and the resin was removed. The properties of the resulting resins A-I are indicated in Table 3.

Next, after mixing 95 parts by weight of each of resins A-I with 5 parts by weight of carbon black, performing melting and kneading with a double-screw extruding machine maintained at a temperature of 150° C. and then cooling, the resins were then crushed and formed into particles of uniform size with a jet mill microcrusher and classifier resulting in the obtaining of toners AT-IT having a particle size of 5–20 μm.

Then, using a heat roller type fixation tester which allows temperature, pressure and roller speed to be changed as desired, fixation tests were performed on toners AT-IT at a nip width of 3 mm and a roller speed of 200 mm/sec.

The fixation temperature range was indicated between the roller temperature when the fixation ratio between the paper and toner exceeds 90% and the temperature when hot offsetting occurs. Measurement of the fixation ratio was performed using a Macbeth reflection densitometer, with the fixation ratio taken to be the ratio between the density of toner fixed onto the paper and the density after peeling of the tape. Those results are indicated in Table 3. As is clear from Table 3, the resin of the present invention demonstrates excellent fixation and non-offsetting properties.

Next, 0.45 parts by weight of toners AT-IT and 10.0 parts by weight of a positive charged ferrite carrier were respectively placed in 50 cc polyethylene sample bottles. After allowing each of the samples to stand for 24 hours under environmental conditions of 22° C.×55% and 35° C.×85%, the carrier and the toner were mixed for 10 minutes with a ball mill turning at 200 rpm. The mixtures of toner and carrier were then removed from each of the sample bottles after which the amount of charge of each sample was measured with a blowoff electric charge measuring device (using the blowoff electric charge measuring device made by Toshiba Chemical Corp.). Those results are indicated in Table 3.

As is clear from Table 3, there was little dependency of the amount of charge on temperature and humidity for each of the samples. This indicates that toners AT-IT have excellent moisture resistance performance.

Moreover, blocking resistance was evaluated by placing 10 g each of toners AT-IT in sample bottles, placing the bottles in a hot air dryer maintained at a temperature of 40° C. and allowing to stand for 50 hours. Those results are indicated in Table 3. As is clear from Table 3, the blocking resistance of toners AT-IT was favorable. Furthermore, the evaluation standards that were used are as indicated below.

◎: Toner is dispersed simply by inverting the sample bottle.

O: Toner is dispersed by inverting the sample bottle and tapping once.

OΔ: Toner is dispersed by inverting the sample bottle and tapping two to four times.

Δ: Toner is dispersed by inverting the sample bottle and tapping two to four times although a small amount of blocking is present.

ΔX: Toner is dispersed by inverting the sample bottle and tapping five to six times although a small amount of blocking is present.

X: Toner is not dispersed even if the sample bottle is inverted and tapped six times or more.

EXAMPLE 2

Other than using the components indicated in Table 2, such as polyester 2 or polyester 3, polymerization was carried out under the same conditions as in Example 1 to obtain resins J and K. The properties of these resins are indicated in Table 3.

Resins J and K were then formed into toner under the same conditions as in Example 1 resulting in toner JT and KT. Evaluation of fixation testing and so on for these toners is indicated in Table 3. As is clear from Table 3, toner JT and KT demonstrate excellent toner properties.

EXAMPLE 3

Other than using the component indicated in Table 2, setting the emulsion polymerization for resin N at 75° C., and setting the emulsion polymerization temperature to 73° C. for resin O, polymerization was carried out under the same conditions as in Example 1 to obtain resins L-O. The properties of these resins are indicated in Table 3.

Resins L-O were then formed into toner under the same conditions as in Example 1 resulting in toners LT-OT. Evaluation of fixation testing and so on for these toners is indicated in Table 3. As is clear from Table 3, toners LT-OT demonstrate excellent toner properties.

EXAMPLE 4

Other than using the components indicated in Table 2 and setting the suspension polymerization temperature at 93° C., polymerization was carried out under the same conditions as in Example 1 to obtain resins P and Q. The properties of these resins are indicated in Table 3.

Resins P and Q were then formed into toner under the same conditions as in Example 1 resulting in toners PT and QT. Evaluation of fixation testing and so on for these toners is indicated in Table 3. As is clear from Table 3, toners PT and QT demonstrate excellent toner properties.

EXAMPLE 5

Other than using the components indicated in Table 2 and setting the suspension polymerization temperature at 70° C. for resin R, polymerization was carried out under the same conditions as in Example 1 to obtain resins R and S. The properties of these resins are indicated in Table 3.

Resins R and S were then formed into toner under the same conditions as in Example 1 resulting in toners RT and ST. Evaluation of fixation testing and so on for these toners is indicated in Table 3. As is clear from Table 3, toners RT and ST demonstrate excellent toner properties.

EXAMPLE 6

Other than using the components indicated in Table 2, such as polyester 2, polymerization was carried out under the same conditions as in Example 1 to obtain resins T and U. The properties of these resins are indicated in Table 3.

Resins T and U were then formed into toner under the same conditions as in Example 1 resulting in toners TT and UT. Evaluation of fixation testing and so on for these toners is indicated in Table 3. As is clear from Table 3, toners TT and UT demonstrate excellent toner properties.

EXAMPLE 7

Other than using the components indicated in Table 2, using polyvinyl alcohol (degree of saponification: 88%) as the dispersant in suspension polymerization for resin V, with the amount added being 4000 ppm with respect to the total amount of all monomers used in suspension polymerization, and using a reactive surface activator wherein a hydrophilic group in the form of $NH_4$ and a lipophilic group in the form of $C_{18}F_1$ are incorporated in the structure of an allyl alcohol as the emulsifier in emulsion polymerization, with the amount added being 5000 ppm with respect to the total amount of all monomers used in emulsion polymerization, polymerization was carried out under the same conditions as in Example 1 to obtain resins V and W. The properties of these resins are indicated in Table 3.

Resins V and W were then formed into toner under the same conditions as in Example 1 resulting in toners VT and WT. Evaluation of fixation testing and so on for these toners is indicated in Table 3. As is clear from Table 3, toners VT and WT demonstrate excellent toner properties.

EXAMPLE 8

Other than using the components indicated in Table 2, polymerization was carried out under the same conditions as in Example 1 to obtain resins X-Z. The properties of these resins are indicated in Table 3.

Resins X-Z were then formed into toner under the same conditions as in Example 1 resulting in toners XT-ZT. Evaluation of fixation testing and so on for these toners is indicated in Table 3. As is clear from Table 3, toners XT-ZT demonstrate excellent toner properties.

COMPARATIVE EXAMPLE 1

Other than using the components indicated in Table 4, carrying out suspension polymerization without using polyester for resin (a), and only using polyester 1 while not carrying out emulsion suspension polymerization for resin (b), polymerization was carried out under the same conditions as in Example 1 to obtain resins (a) and (b). The properties of these resins are indicated in Table 5.

Resins (a) and (b) were then formed into toner under the same conditions as in Example 1 resulting in toners (a)T and (b)T. Evaluation of fixation testing and so on for these toners is indicated in Table 5. As is clear from Table 5, toner (a)T has a high fixation temperature (lower limit of temperature range), and fixation properties are inferior to all of the toners of the examples. In addition, the temperature at which hot offsetting occurs of toner (b)T was lower than all of the toners of the examples, there was no fixation temperature range and moisture resistance was poor.

COMPARATIVE EXAMPLE 2

Other than using the components indicated in Table 4, setting the emulsion polymerization temperature to 80° C. for resin (i), and setting the suspension polymerization temperature to 65° C. and the polymerization time to 12 hours for resin (j), polymerization was carried out under the same conditions as in Example 1 to obtain resins (c)–(j). The properties of those resins are indicated in Table 5.

Resins (c)–(j) were then formed into toner under the same conditions as in Example 1 resulting in toners (c)T–(j)T. Evaluation of fixation testing and so on for these toners is indicated in Table 5.

As is clear from Table 5, toners (d)T, (f)T, (h)T and (j)T all have high fixation temperatures, and their fixation properties are inferior to all of the toners of the examples. The temperature at which hot offsetting occurs of toner (c)T, (e)T and (i)T was lower than and inferior to all of the toners of the examples. Toners (c)T and (e)T had a poor blocking resistance inferior to all of the toners of the examples. Moreover, toners (c)T and (g)T had a poor moisture resistance inferior to all of the toners of the examples.

COMPARATIVE EXAMPLE 3

Polymerization was carried out using the components indicated in Table 4 under the same conditions as in Example 1 to obtain resins (k) and (l). The properties of those resins are indicated in Table 5.

Resins (k) and (l) were then formed into toner under the same conditions as in Example 1 resulting in toners (k)T and (l)T. Evaluation of fixation testing and so on for these toners is indicated in Table 5.

As is clear from Table 5, toner (k)T has a poor moisture resistance inferior to all of the toners of the examples. The fixation temperature of toner (l)T is high, and its fixation properties are inferior to all of the toners of the examples.

COMPARATIVE EXAMPLE 4

Firstly, polyesters 4 to 6 indicated below were prepared.

Polyester 4

(Terephthalic acid / isophthalic acid / ethylene glycol=2.10 / 0.90 / 3.24[moles]), Tg=74° C., softening temperature=180° C., acid value=20 mgKOH/g, Mw=4,000

Polyester 5

(Terephthalic acid / neopentyl glycol/polyoxypropylene-(2,4)-2,2-bis(4-hydroxyphenyl) propane / ethylene glycol=2.36 / 0.94 / 0.24 / 1.18 [moles]), Tg=65° C., softening temperature=150° C., acid value=1.0 mgKOH/g, Mw=28,000

Polyester 6

(Terephthalic acid / polyoxypropylene-(2,4)-2,2-bis(4-hydroxyphenyl)propane=2.36 / 2.36 [moles]), Tg=35° C., softening temperature=60° C., acid value=20 mgKOH/g, Mw=2,000

Other than using the components indicated in Table 4 such as polyesters 4–6, polymerization was carried out under the same conditions as in Example 1 to obtain resins (m)–(o). The properties of those resins are indicated in Table 5.

Resins (m)–(o) were then formed into toner under the same conditions as in Example 1 resulting in toners (m)T–(o)T. Evaluation of fixation testing and so on for these toners is indicated in Table 5.

As is clear from Table 5, the fixation temperatures of toners (m)T and (n)T are high, and their fixation properties are inferior to all of the toners of the examples. The hot offsetting temperature of toner (o)T is lower than and inferior to all of the toners of the examples. In addition, toner (o)T also has a poor blocking resistance. Moreover, toners (m)T and (o)T have a poor moisture resistance inferior to all of the toners of the examples.

EXAMPLE 9

Styrene, n-butylacrylate and potassium persulfate methyl acrylate, ethylacrylate and potassium persulfate were placed in a 5 liter reaction vessel equipped with a distillation column and stirrer in accordance with the composition of Table 6 and mixed. In addition, 4000 ppm of dispersant A with respect to the amount of monomers placed in the reaction vessel, and 6 volumes of deionized water with respect to the amount of monomers were also placed in the reaction vessel. Next, $N_2$ gas was fed into the reaction vessel for roughly 1 hour. The reaction temperature was then maintained at 70° C. while holding the stirring rate at 175 rpm and setting the $N_2$ gas flow rate to 100 ml/min. When the temperature inside the reaction system reached 70° C., emulsion polymerization gradually began resulting in the formation of reflux. Reflux of the reaction system discontinued after roughly 4 hours from the beginning of emulsion polymerization at which time the flow of $N_2$ gas was stopped and emulsion polymerization was terminated.

Next, after lowering the temperature of the reaction system to 40° C., deionized water in an amount equal to the total amount of all monomers used in suspension polymerization, 600 ppm of dispersant A and 300 ppm of sodium polyacrylate with respect to the total amount of all monomers used in suspension polymerization, 1 wt % of mirabilite with respect to the total amount of all monomers used in suspension polymerization, as well as styrene, n-butylacrylate, α-methylstyrene dimer, glycidyl methacrylate and benzoyl peroxide were placed in the reaction vessel in accordance with the composition of Table 6 followed by mixing for roughly 1 hour while maintaining the stirring rate at 350 rpm. After 1 hour, the temperature was raised until the temperature of the reaction system reached 85° C. When the temperature of the reaction system reached 85° C., the reaction system began to give off heat. Suspension polymerization was then carried out while maintaining the outside temperature at 82° C. and controlling the temperature of the reaction system at 85° C. 1 hour after the temperature of the reaction system reached 85° C., the reaction no longer gave off heat and the outside temperature of the reaction system was increased to 88° C. While maintaining the temperature within the reaction system at 85° C., suspension polymerization was terminated maintaining this state after roughly an additional 1 hour.

Next, the reaction system was heated to 100° C. and residual monomers were removed from the reaction system. The temperature of the reaction system was then lowered and maintained at 90° C. followed by alkaline treatment for roughly 30 minutes with 0.5 wt % sodium hydroxide with respect to the total amount of all monomers used in suspension polymerization. The reaction system was then cooled to lower the temperature to room temperature and the resin was removed. The properties of the resulting resins α-δ are indicated in Table 6.

Next, after mixing 95 parts by weight of each of resins α-δ blended with polyesters 1 and 2 in accordance with the mixing ratios of Table 6 with 5 parts by weight of carbon black, performing melting and kneading with a double-screw extruding machine maintained at a temperature of 150° C. and then cooling, the resins were then crushed and formed into particles of uniform size with a jet mill microcrusher and classifier resulting in the obtaining of toners αT-δT having a particle size of 5–20 μm. The characteristic values of those toners are indicated in Table 6.

Next, evaluations of fixation testing, charging characteristics and so on were performed under the same conditions as in Example 1. Those results are indicated in Table 7. As is clear from the results of Table 7, toners αT-δT demonstrate excellent toner properties.

TABLE 2

| | Resin | Emulsion Polymerization Composition (parts by weight) | | | | | | | Suspension Polymerization Composition (parts by weight) | | | | | | | | | | | | |
|---|---|---|---|---|---|---|---|---|---|---|---|---|---|---|---|---|---|---|---|---|---|
| | No. | St | n-BA | n-BMA | MA | EA | KPS | APS | PET 1 | PET 2 | PET 3 | GMA | St | n-BA | n-BMA | MA | EA | MAA | MSt | BPO | Azo |
| Example 1 | A | 176 | 44 | — | — | — | 0.44 | — | 150 | — | — | 4.5 | 500.4 | 125.1 | — | — | — | — | 12.51 | 50.0 | — |
| | B | 136 | 34 | — | — | — | 0.34 | — | 150 | — | — | 4.5 | 540.4 | 135.1 | — | — | — | — | 13.51 | 54.0 | — |
| | C | 96 | 24 | — | — | — | 0.24 | — | 150 | — | — | 4.5 | 580.4 | 145.1 | — | — | — | — | 14.51 | 58.0 | — |
| | D | 119 | — | — | 51 | — | 0.34 | — | 150 | — | — | 4.5 | 472.9 | — | — | 202.7 | — | — | 13.51 | 54.0 | — |
| | E | 119 | — | 51 | — | — | 0.34 | — | 150 | — | — | 4.5 | 472.9 | — | 202.7 | — | — | — | 13.51 | 54.0 | — |
| | F | 128 | — | — | — | 42 | 0.34 | — | 150 | — | — | 4.5 | 506.6 | — | — | — | 168.9 | — | 13.51 | 54.0 | — |
| | G | 136 | 34 | — | — | — | 0.34 | — | 150 | — | — | 4.5 | 472.9 | 33.8 | — | 168.9 | — | — | 13.51 | 54.0 | — |
| | H | 136 | 34 | — | — | — | 0.34 | — | 80 | — | — | 2.4 | 523.3 | 37.4 | — | 186.9 | — | — | 14.95 | 59.8 | — |
| | I | 136 | 34 | — | — | — | 0.34 | — | 350 | — | — | 10.5 | 328.7 | 23.5 | — | 117.4 | — | — | 9.39 | 37.6 | — |
| Example 2 | J | 119 | — | — | 51 | — | 0.34 | — | — | 150 | — | 4.5 | 472.9 | — | — | 202.7 | — | — | 13.30 | 53.2 | — |
| | K | 119 | — | — | 51 | — | 0.34 | — | — | — | 150 | 1.5 | 475.0 | — | — | 203.5 | — | — | 13.60 | 54.3 | — |
| Example 3 | L | 136 | 34 | — | — | — | 0.34 | — | 150 | — | — | 4.5 | 540.4 | 135.1 | — | — | — | — | 20.27 | 60.8 | — |
| | M | 136 | 34 | — | — | — | 0.34 | — | 150 | — | — | 4.5 | 540.4 | 135.1 | — | — | — | — | 3.38 | 27.0 | — |
| | N | 136 | 34 | — | — | — | 0.51 | — | 150 | — | — | 4.5 | 540.4 | 135.1 | — | — | — | — | 13.51 | 54.0 | — |
| | O | 136 | 34 | — | — | — | 0.43 | — | 150 | — | — | 4.5 | 540.4 | 135.1 | — | — | — | — | 13.51 | 54.0 | — |
| Example 4 | P | 123 | 27 | — | — | — | 0.30 | — | 150 | — | — | 4.5 | 556.4 | — | — | — | 139.1 | — | 13.91 | 55.6 | — |
| | Q | 123 | 27 | — | — | — | 0.30 | — | 150 | — | — | 4.5 | 556.4 | 34.8 | — | — | 104.3 | — | 13.91 | 55.6 | — |
| Example 5 | R | 136 | 34 | — | — | — | 0.34 | — | 150 | — | — | 4.5 | 540.4 | 135.1 | — | — | — | — | 13.51 | — | 54.0 |
| | S | 136 | 34 | — | — | — | — | 0.34 | 150 | — | — | 4.5 | 540.4 | 135.1 | — | — | — | — | 13.51 | 54.0 | — |
| Example 6 | T | 119 | — | — | 51 | — | 0.34 | — | — | 150 | — | 22.5 | 460.3 | — | — | 197.3 | — | — | 13.30 | 53.2 | — |
| | U | 119 | — | — | 51 | — | 0.34 | — | — | 150 | — | 37.5 | 449.8 | — | — | 192.8 | — | — | 13.30 | 53.2 | — |
| Example 7 | V | 136 | 34 | — | — | — | 0.34 | — | 150 | — | — | 4.5 | 540.4 | 135.1 | — | — | — | — | 13.51 | 54.0 | — |
| | W | 136 | 34 | — | — | — | 0.34 | — | 150 | — | — | 4.5 | 540.4 | 135.1 | — | — | — | — | 13.51 | 54.0 | — |
| Example 8 | X | 136 | 34 | — | — | — | 0.34 | — | 150 | — | — | 4.5 | 472.9 | 202.7 | — | — | — | — | 13.51 | 54.0 | — |
| | Y | 136 | 34 | — | — | — | 0.34 | — | 150 | — | — | 4.5 | 540.4 | 128.4 | — | — | — | 6.8 | 13.51 | 54.0 | — |
| | Z | 136 | 34 | — | — | — | 0.34 | — | 150 | — | — | 4.5 | 540.4 | 121.6 | — | — | — | 13.5 | 13.51 | 54.0 | — |

Monomer Symbols Used in Table:
St: Styrene
n-BA: n-Butylacrylate
n-BMA: n-Butylmethacrylate
EA: Ethylacrylate
MA: Methylacrylate
MAA: Methacrylic acid
GMA: Glycidyl methacrylate
MSt: α-Methylstyrene dimer
PET 1: Polyester 1
PET 2: Polyester 2
PET 3: Polyester 3
BPO: Benzoyl peroxide
Azo: 2,2'-azobis(2-methylbutyronitrile)
KPS: Potassium persulfate
APS: Ammonium persulfate

TABLE 3

| | | Resin Properties | | | | | | Toner Properties | | | | |
|---|---|---|---|---|---|---|---|---|---|---|---|---|
| | Resin No. | Tg (°C.) | Softening Temperature (°C.) | Acid Value (mgKOH/g) | High Molecular Weight (B1) Mw(× $10^4$) | Low Molecular Weight (B2) Mw(× $10^4$) | Molecular Weight Ratio (B1/B2) (weight) | Toner Symbol | Fixation Temperature Range (°C.) | Blocking Resistance | Charge Amount (μC/g) 20° C., 60% | Charge Amount (μC/g) 35° C., 85% |
| Example 1 | A | 60.0 | 132 | 3.1 | 105 | 1.5 | 22/78 | AT | 142–240 | ◎ | 8.5 | 8.4 |
| | B | 57.5 | 129 | 3.0 | 100 | 1.4 | 17/83 | BT | 139–230 | ○ | 8.3 | 8.0 |
| | C | 52.5 | 122 | 3.0 | 102 | 1.5 | 12/88 | CT | 132–200 | ○Δ | 8.4 | 7.8 |
| | D | 64.0 | 138 | 3.0 | 100 | 2.2 | 17/83 | DT | 148–230 | ◎ | 7.0 | 6.4 |
| | E | 55.0 | 126 | 4.0 | 100 | 1.5 | 17/83 | ET | 136–230 | ○ | 8.0 | 7.4 |
| | F | 62.0 | 137 | 3.0 | 105 | 2.0 | 17/83 | FT | 147–230 | ◎ | 9.0 | 8. |
| | G | 60.0 | 135 | 3.1 | 108 | 2.0 | 17/83 | GT | 145–230 | ◎ | 7.5 | 7. |
| | H | 62.0 | 140 | 1.5 | 108 | 2.2 | 17/83 | HT | 150–230 | ◎ | 7.8 | 7.7 |
| | I | 53.0 | 128 | 5.0 | 108 | 2.0 | 17/83 | IT | 138–230 | ○Δ | 6.0 | 5.0 |
| Example 2 | J | 60.0 | 120 | 3.1 | 108 | 1.3 | 17/83 | JT | 128–230 | ◎ | 7.0 | 6.0 |
| | K | 64.5 | 150 | 1.0 | 108 | 2.0 | 17/83 | KT | 155–230 | ◎ | 7.0 | 6.7 |
| Example 3 | L | 50.0 | 115 | 3.0 | 108 | 0.8 | 17/83 | LT | 120–220 | ○Δ | 8.2 | 8.0 |
| | M | 65.0 | 153 | 1.5 | 108 | 8.2 | 17/83 | MT | 158–230 | ◎ | 8.4 | 8.3 |
| | N | 55.0 | 126 | 3.0 | 60 | 1.4 | 17/83 | NT | 135–200 | ○ | 8.3 | 8.0 |
| | O | 56.5 | 127 | 3.0 | 80 | 1.4 | 17/83 | OT | 137–220 | ○ | 8.4 | 8.1 |
| Example 4 | P | 60.0 | 128 | 3.1 | 100 | 1.4 | 15/85 | PT | 138–210 | ◎ | 9.0 | 8.9 |
| | Q | 59.0 | 125 | 2.8 | 102 | 1.5 | 15/85 | QT | 135–210 | ○ | 8.8 | 8.6 |
| Example 5 | R | 57.5 | 131 | 0.5 | 100 | 1.4 | 17/83 | RT | 140–230 | ○ | 8.0 | 8.0 |
| | S | 57.5 | 129 | 3.0 | 90 | 1.4 | 17/83 | ST | 139–230 | ○ | 8.0 | 8.0 |
| Example 6 | T | 60.0 | 140 | 2.5 | 105 | 2.5 | 17/83 | TT | 150–230 | ◎ | 8.0 | 7.8 |
| | U | 57.0 | 142 | 2.0 | 106 | 2.4 | 17/83 | UT | 152–230 | ○ | 9.0 | 8. |
| Example 7 | V | 57.5 | 129 | 3.5 | 100 | 1.4 | 17/83 | VT | 139–230 | ○ | 8.2 | 8. |
| | W | 58.0 | 128 | 3.0 | 80 | 1.4 | 17/83 | WT | 138–220 | ○ | 8.5 | 8.4 |
| Example 8 | X | 45.0 | 110 | 3.0 | 100 | 1.4 | 17/83 | XT | 120–210 | Δ | 8.5 | 7.5 |
| | Y | 60.0 | 129 | 6.0 | 100 | 1.5 | 17/83 | YT | 140–230 | ○ | 8.2 | 7.2 |
| | Z | 62.5 | 130 | 8.0 | 100 | 1.8 | 17/83 | ZT | 140–230 | ○ | 8.3 | 7.3 |

Tg: Glass transition temperature
Ranking of evaluation of blocking resistance
(Good) ◎ > ○ > ○Δ > Δ > ΔX > X (Defective)
Usable Level: Δ or higher

TABLE 4

| | Resin No. | Emulsion Polymerization Composition (parts by weight) | | | | | Suspension Polymerization Composition (parts by weight) | | | | | | | | | | | | |
|---|---|---|---|---|---|---|---|---|---|---|---|---|---|---|---|---|---|---|---|
| | | St | n-BA | MA | EA | KPS | PET 1 | PET 4 | PET 5 | PET 6 | GMA | St | n-BA | n-BMA | MA | EA | MAA | MSt | BPO |
| Comparative | a | 96 | 24 | — | — | 0.24 | — | — | — | — | 4.5 | 700.4 | 175.1 | — | — | — | — | 17.60 | 70.4 |
| Example 1 | b | — | — | — | — | — | 1000 | — | — | — | — | — | — | — | — | — | — | — | — |
| Comparative | c | 68 | 102 | — | — | 0.34 | 150 | — | — | — | 4.5 | 270.2 | 405.3 | — | — | — | — | 13.51 | 54.0 |
| Example 2 | d | 170 | — | — | — | 0.34 | 150 | — | — | — | 4.5 | 675.5 | — | — | — | — | — | 13.51 | 54. |
| | e | 96 | 24 | — | — | 0.24 | 150 | — | — | — | 4.5 | 580.4 | 145.1 | — | — | — | — | 29.02 | 96. |
| | f | 96 | 24 | — | — | 0.24 | 150 | — | — | — | 4.5 | 580.4 | 145.1 | — | — | — | — | — | 21.8 |
| | g | 136 | 34 | — | — | 0.34 | 150 | — | — | — | 4.5 | 540.4 | 108.1 | — | — | — | 27.0 | 13.51 | 54.0 |
| | h | 224 | 56 | — | — | 0.56 | 150 | — | — | — | 4.5 | 452.4 | 113.1 | — | — | — | — | 11.31 | 45.2 |
| | i | 176 | 44 | — | — | 1.10 | 150 | — | — | — | 4.5 | 437.9 | — | 187.6 | — | — | — | 12.51 | 50.0 |
| | j | 84 | — | 36 | — | 0.24 | 350 | — | — | — | 10.5 | 363.7 | — | — | 155.8 | — | — | 2.60 | 5.2 |
| Comparative | k | 128 | — | — | 42 | 0.34 | 150 | — | — | — | — | 511.1 | — | — | — | 168.9 | — | 13.51 | 54.0 |
| Example 3 | l | 128 | — | — | 42 | 0.34 | 150 | — | — | — | 60.0 | 496.0 | — | — | — | 334.0 | — | 12.40 | 49.6 |
| Comparative | m | 136 | 34 | — | — | 0.34 | — | 150 | — | — | 45.0 | 508.0 | 127.0 | — | — | — | — | 12.70 | 50.8 |
| Example 4 | n | 136 | 34 | — | — | 0.34 | — | — | 150 | — | 45.0 | 508.0 | 127.0 | — | — | — | — | 12.70 | 50.8 |
| | o | 136 | 34 | — | — | 0.34 | — | — | — | 150 | 45.0 | 508.0 | 127.0 | — | — | — | — | 12.70 | 50.8 |

St: Styrene
n-BA: n-Butylacrylate
n-BMA: n-Butylmethacrylate
EA: Ethylacrylate
MA: Methylacrylate
MAA: Methacrylic acid
GMA: Glycidyl methacrylate
MSt: α-Methylstyrene dimer
PET 1: Polyester 1
PET 4: Polyester 4
PET 5: Polyester 5
PET 6: Polyester 6
BPO: Benzoyl peroxide
KPS: Potassium persulfate

TABLE 5

| | Resin Properties | | | | | | | Toner Properties | | | | |
|---|---|---|---|---|---|---|---|---|---|---|---|---|
| | Resin No. | Tg (°C.) | Softening Temperature (°C.) | Acid Value (mgKOH/g) | High Molecular Weight (B1) Mw(× $10^4$) | Low Molecular Weight (B2) Mw(× $10^4$) | Molecular Weight Ratio (B1/B2) (weight) | Toner Symbol | Fixation Temperature Range (°C.) | Blocking Resistance | Charge Amount (μC/g) 20° C., 60% | Charge Amount (μC/g) 35° C., 85% |
| Comparative Example 1 | a | 62.0 | 136 | 0.5 | 100 | 1.7 | 12/88 | aT | 165–230 | ◎ | 8.9 | 8.9 |
| | b | 57.0 | 105 | 4.0 | — | 0.6 | — | bT | 110–110 | ○ | 4.0 | |
| Comparative Example 2 | c | 36.0 | 98 | 3.0 | 106 | 1.4 | 17/83 | cT | 110–190 | ΔX | 10.0 | 5.0 |
| | d | 90.0 | 178 | 2.5 | 108 | 1.5 | 17/83 | dT | 188–230 | ◎ | 6.0 | 5.9 |
| | e | 35.0 | 88 | 3.0 | 106 | 1.0 | 12/88 | eT | 98–180 | ΔX | 8.0 | 7.5 |
| | f | 65.0 | 165 | 3.0 | 105 | 11.0 | 12/88 | fT | 175–200 | ◎ | 8.0 | 7.9 |
| | g | 64.0 | 135 | 12.0 | 102 | 2.0 | 17/83 | gT | 145–230 | ◎ | 8.8 | 4.0 |
| | h | 65.0 | 150 | 3.0 | 100 | 1.5 | 28/72 | hT | 170–250 | ◎ | 8.5 | 8.4 |
| | i | 58.0 | 130 | 3.5 | 30 | 1.5 | 22/78 | iT | 140–170 | ○ | 8.0 | 7.5 |
| | j | 69.0 | 163 | 3.0 | 100 | 15.0 | 12/88 | jT | 170–230 | ◎ | 7.0 | 6.5 |
| Comparative Example 3 | k | 64.0 | 138 | 5.0 | 105 | 2.2 | 17/83 | kT | 148–230 | ◎ | 8.0 | 5.0 |
| | l | 70.0 | 165 | 2.0 | 120 | 3.5 | 17/83 | lT | 175–240 | ◎ | 8.9 | 8.7 |
| Comparative Example 4 | m | 66.0 | 155 | 5.0 | 101 | 1.4 | 17/83 | mT | 165–230 | ◎ | 8.0 | 5.0 |
| | n | 63.0 | 150 | 3.0 | 105 | 3.0 | 17/83 | nT | 165–230 | ◎ | 8.0 | 7.8 |
| | o | 35.0 | 80 | 5.0 | 105 | 4.0 | 17/83 | oT | 100–130 | ΔX | 8.0 | 4.0 |

Tg: Glass transition temperature
Ranking of evaluation of blocking resistance
(Good) ◎ > ○ > ○Δ > Δ > ΔX > X (Defective)
Usable Level: Δ or higher

TABLE 6

| | Resin No. | Styrene-Acrylic Copolymer: Emulsion Polymerization Composition (parts by weight) St | n-BA | KPS | Suspension Polymerization Composition (parts by weight) GMA | St | n-BA | MSt | BPO | Tg (°C.) | Softening Temperature (°C.) |
|---|---|---|---|---|---|---|---|---|---|---|---|
| Example 9 | α | 136 | 34 | 0.34 | 5.8 | 659.8 | 164.9 | 16.50 | 66.0 | 60.5 | 136 |
| | β | 136 | 34 | 0.34 | 7.5 | 658.0 | 164.5 | 16.45 | 65.8 | 59.5 | 137 |
| | γ | 136 | 34 | 0.34 | 12.8 | 653.8 | 163.4 | 16.34 | 65.4 | 58.0 | 137 |
| | δ | 139 | 31 | 0.34 | 7.5 | 674.5 | 148.0 | 16.45 | 65.8 | 60.0 | 139 |

| | Styrene-Acrylic Copolymer: Acid Value (mgKOH/g) | High Molecular Weight (A) Mw (× $10^4$) | Low Molecular Weight (B) Mw (× $10^4$) | Molecular Weight Ratio (A/B) (weight) | Polyester Polymer Used | Styrene-Acrylic/Polyester Mixing Ratio |
|---|---|---|---|---|---|---|
| Example 9 | 0.9 | 105 | 1.8 | 17/83 | PET 1 | 85/15 |
| | 1.0 | 101 | 1.7 | 17/83 | PET 1 | 80/20 |
| | 0.8 | 103 | 1.8 | 17/83 | PET 1 | 70/30 |
| | 1.2 | 100 | 1.8 | 17/83 | PET 2 | 85/15 |

St: Styrene
KPS: Potassium persulfate
n-BA n-Butylacrylate
GMA: Glycidyl methacrylate
MSt: α-Methylstyrene dimer
PET 1: Polyester 1
PET 2: Polyester 2
BPO: Benzoyl peroxide

TABLE 7

| | Characteristic Values After Mixing and Kneading | | | | | | | Toner Properties | | | | |
|---|---|---|---|---|---|---|---|---|---|---|---|---|
| | Resin No. | Tg (°C.) | Softening Temperature (°C.) | Acid Value (mgKOH/g) | High Molecular Weight (A) Mw (× $10^4$) | Low Molecular Weight (B) Mw (× $10^4$) | Molecular Weight Ratio (A/B) (weight) | Toner Symbol | Fixation Temperature Range (°C.) | Blocking Resistance | Charge Amount (μC/g) 20° C., 60% | Charge Amount (μC/g) 35° C., 85% |
| Example 9 | α | 60.0 | 128 | 1.5 | 75 | 1.8 | 16/84 | αT | 146–210 | ◎ | 9.0 | 8.3 |
| | β | 59.0 | 127 | 1.8 | 78 | 1.8 | 15/85 | βT | 145–210 | ○ | 8.8 | 8.0 |
| | γ | 57.8 | 124 | 2.1 | 80 | 1.7 | 12/88 | γT | 142–200 | ○ | 8.2 | 7.2 |
| | δ | 57.3 | 120 | 3.5 | 85 | 1.6 | 15/85 | δT | 133–210 | ○ | 7.0 | 6.2 |

Tg: Glass transition temperature
Ranking of evaluation of blocking resistance
(Good) ◎ > ○ > ○Δ > Δ > ΔX > X (Defective)
Usable Level: Δ or higher As explained above, the toner resin composition and its preparation process of the present invention is endowed with the respective superior characteristics of styrene-acrylic and polyester resins, having a stable quality as well as excellent non-offsetting properties, low temperature fixation properties, blocking resistance, and moisture resistance.

Thus, toner images can be developed both stably and rapidly to thereby allow the realization of a high-speed operation of, for example, copiers and laser beam printers.

We claim:

1. A toner resin composition comprising a uniform dispersion of 5 to 40% by weight of a linear polyester (A) having a weight average molecular weight of 3,000 to 20,000 and 50 to 95% by weight of a styrene-acrylic copolymer (B), wherein said styrene-acrylic copolymer (B) is comprised of 10 to 25% by weight of a high molecular weight polymer (B1) having a weight average molecular weight of 500,000 to 1,100,000 and 75 to 90% by weight of a low molecular weight polymer (B2) having a weight average molecular weight of 5,000 to 100,000, said high molecular weight polymer (B1) is comprised of a styrene component (b-1) and an acrylic ester and/or methacrylic ester component (b-2), and said low molecular weight polymer (B2) is comprised of a styrene component (b-1), an acrylic ester and/or methacrylic ester component (b-2), 0.3 to 3 parts by weight, per 100 parts of the total weight of said component (b-1) and component (b-2), of an α-methyl styrene dimer (b-3) and 0.5 to 30 parts by weight, per 100 parts by weight of said polyester (A), of a glycidyl methacrylate component (b-4).

2. A composition as set forth in claim 1, which has a glass transition temperature of 40° to 68° C., a softening point of 100° to 160° C. and an acid value of 0.1 to 10 mgKOH/g.

3. A composition as set forth in claim 1, wherein said polyester (A) has a structure originating in a divalent carboxylic acid component (a-1), 0.2 to 0.7 mole, per mole of said divalent carboxylic acid, of an aromatic diol component (a-2) and 0.3 to 0.8 mole, per mole of said divalent carboxylic acid, of an aliphatic diol component (a-3).

4. A composition as set forth in claim 3, wherein said divalent carboxylic acid component (a-1) is selected from the group consisting of maleic acid, fumaric acid, itaconic acid, cyclohexane dicarboxylic acid, terephthalic acid, isophthalic acid, adipic acid and sebacic acid.

5. A composition as set forth in claim 3, wherein said aromatic diol component (a-2) is selected from the group consisting of bis-phenol A, bis-phenol S, bisphenol F, hydrogenated bis-phenol A, polyoxypropylene-(n)-polyoxyethylene-(n')-2,2-bis(4-hydroxyphenyl)propane, polyoxypropylene-(n')-2,2-bis(4-hydroxyphenyl)propane, polyoxyethylene-(n)-2,2-bis(4-hydroxyphenyl)propane and polyoxypropylene-(n)-hydroxone (where $2 \leqq n$ and $n' \leqq 6$).

6. A composition as set forth in claim 3, wherein said aliphatic diol component (a-3) is selected from the group consisting of ethylene glycol, diethylene glycol, triethylene glycol, polyethylene glycol, propylene glycol, 1,2-butanediol, 1,3-butanediol, cyclohexane dimethanol and neopentyl glycol.

7. A composition as set forth in claim 1, wherein said polyester (A) has a weight average molecular weight of 3,000 to 20,000, an acid value of 0.5 to 10 mgKOH/g, a glass transition temperature of 40° to 68° C. and a softening temperature of 80° to 160° C.

8. A composition as set forth in claim 1, wherein said styrene-acrylic copolymer (B) is comprised of a styrene component (b-1), an acrylic ester and/or methacrylic ester component (b-2), an α-methyl styrene dimer (b-3) and a glycidyl methacrylate component (b-4) in amounts, per 100 parts of the total weight of said component (b-1) and component (b-2), of 50 to 90 parts by weight of said component (b-1), 10 to 50 parts by weight of said component (b-2) and 0.3 to 3 parts by weight of said dimer (b-3) and 0.5 to 30 parts by weight, per 100 parts by weight of said polyester (A), of said component (b-4).

9. A composition as set forth in claim 1, wherein said styrene component (b-1) is selected from the group consisting of styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-phenylstyrene and 3,4-dichlorostyrene.

10. A composition as set forth in claim 1, wherein said acrylic ester and/or methacrylic ester component (b-2) is selected from the group consisting of ethyl acrylate, methyl acrylate, n-butyl acrylate, isobutyl acrylate, propyl acrylate, 2-ethylhexyl acrylate, stearyl acrylate, ethyl methacrylate, methyl methacrylate, n-butyl methacrylate, isobutyl methacrylate, propyl methacrylate, 2-ethylhexyl methacrylate, stearyl methacrylate, dimethylaminoethyl methacrylate and diethylaminoethyl methacrylate.

11. A composition as set forth in claim 1, wherein the ratio of the amounts of said styrene component (b-1) to said acrylic ester and/or methacrylic ester component (b-2) is such that the amount of the component (b-1) is 50 to 90 parts by weight and the amount of the component (b-2) is 10 to 50 parts by weight with respect to 100 parts by weight of the total amounts of the component (b-1) and component (b-2).

12. A composition as set forth in claim 1, wherein said styrene-acrylic copolymer (B) has a glass transition temperature of 40° to 68° C. and a softening point of 100° to 160° C.

13. A toner resin composition comprising a uniform dispersion of:

5 to 40% by weight of a linear polyester (A) having a structure originating in a divalent carboxylic acid component (a-1), 0.2 to 0.7 mole, per mole of said divalent carboxylic acid, of an aromatic diol component (a-2) and 0.3 to 0.8 mole, per mole of said divalent carboxylic acid, of an aliphatic diol component (a-3) and having a weight average molecular weight of 3,000 to 20,000, an acid value of 0.5 to 10 mgKOH/g, a glass transition temperature of 40° to 68° C. and a softening temperature of 80° to 160° C.; and, 60 to 95% by weight of a styrene-acrylic copolymer (B) formed by using a styrene component (b-1), an acrylic ester and/or methacrylic ester component (b-2), an α-methyl styrene dimer (b-3) and a glycidyl methacrylate component (b-4) in amounts, per 100 parts of the total weight of said component (b-1) and component (b-2), of 50 to 90 parts by weight of said component (b-1), 10 to 50 parts by weight of said component (b-2) and 0.3 to 3 parts by weight of said dimer (b-3) and 0.5 to 30 parts by weight, per 100 parts by weight of said polyester (A), of said component (b-4);

wherein said styrene-acrylic copolymer (B) is comprised of 10 to 25% by weight of a high molecular weight polymer (B1) having a weight average molecular weight of 500,000 to 1,100,000 and 75 to 90% by weight of a low molecular weight polymer having a weight average molecular weight of 5,000 to 100,000, and has a glass transition temperature of 40° to 68° C., a softening point of 100° to 160° C. and an acid value of 0.1 to 10 mgKOH/g.

14. A process for preparing a toner resin composition comprising a linear polyester (A) a styrene-acrylic copolymer (B) wherein said styrene-acrylic copolymer (B) is comprised of 10 to 25% by weight of a high molecular weight polymer (B1) having a weight average molecular weight of 500,000 to 1,100,000 and 75 to 90% by weight of a low molecular weight polymer (B2) having a weight average molecular weight of 5,000 to 100,000, which process comprises of the steps of, subjecting 10 to 25% by weight of a styrene component (b-1) and an acrylic ester and/or methacrylic ester component (b-2) to form an emulsion of a high molecular weight polymer (B1) having a weight average molecular weight of 500,000 to 1,100,000 to emulsion polymerization, and adding, to the obtained emulsion, 5 to 40% by weight of a polyester (A) having a weight average molecular weight of 3,000 to 20,000 and at least a styrene component (b-1), an acrylic ester and/or methacrylic ester component (b-2), 0.3 to 3 parts by weight, per 100 parts of the total weight of said component (b-1) and component (b-2), of an $\alpha$-methyl styrene dimer (b-3) and 0.5 to 30 parts by weight, per 100 parts by weight of said polyester (A), of a glycidyl methacrylate component (b-4), and subjecting the mixture to suspension polymerization.

15. A process according to claim 14, wherein the emulsion polymerization is carried out in the presence of an emulsifier and a polymerization initiator.

16. A process according to claim 15, wherein the emulsifier is selected from nonionic and anionic hydrophilic emulsifiers and lipophilic emulsifiers.

17. A process according to claim 16, wherein the emulsifier is used in an amount of 0.2 to 4 parts by weight and the polymerization initiator is used in an amount of 0.1 to 0.4 part by weight, per 100 parts by weight of the total amounts of the component (b-1) and component (b-2).

18. A process according to claim 17, wherein the emulsion polymerization is carried out at a temperature of 65° to 75° C.

19. A process according to claim 15, wherein the emulsifier is selected from reactive surface active agents.

20. A process according to claim 19, wherein the emulsifier is used in an amount of 0.1 to 2 parts by weight and the polymerization initiator is used in an amount of 0.1 to 0.4 part by weight, per 100 parts by weight of the total amounts of the component (b-1) and component (b-2).

21. A process according to claim 20, wherein the emulsion polymerization is carried out at a temperature of 65° to 75° C.

22. A process according to claim 14, wherein the suspension polymerization is carried out in the presence of deionized water, a dispersant, a polymerization stabilizer and a polymerization initiator.

23. A process according to claim 16, wherein the dispersant is used in an amount of 0.05 to 1 part by weight and the polymerization initiator is used in an amount of 3 to 10 parts by weight, per 100 parts by weight of the total amounts of the component (b-1), component (b-4) and polyester (A).

24. A process according to claim 20, wherein the suspension polymerization is carried out at a temperature of 70° to 98° C.

* * * * *